US010768574B1

(12) United States Patent
Ogiwara et al.

(10) Patent No.: US 10,768,574 B1
(45) Date of Patent: Sep. 8, 2020

(54) IMAGE FORMING APPARATUS

(71) Applicant: TOSHIBA TEC KABUSHIKI KAISHA, Shinagawa-ku, Tokyo (JP)

(72) Inventors: Takashi Ogiwara, Numazu Shizuoka (JP); Masafumi Yoshida, Sunto Shizuoka (JP); Kazuyoshi Takeshita, Fujinomiya Shizuoka (JP); Kazumasa Yasui, Arakawa Tokyo (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/569,973

(22) Filed: Sep. 13, 2019

(51) Int. Cl.
*G03G 21/20* (2006.01)

(52) U.S. Cl.
CPC ..... *G03G 21/206* (2013.01)

(58) Field of Classification Search
None
See application file for complete search history.

(56) References Cited

U.S. PATENT DOCUMENTS

2009/0010672 A1* 1/2009 Watanabe ..... G03G 21/206 399/92

FOREIGN PATENT DOCUMENTS

JP 2001-255793 A 9/2001

* cited by examiner

*Primary Examiner* — Victor Verbitsky
(74) *Attorney, Agent, or Firm* — Foley & Lardner LLP

(57) ABSTRACT

An image forming apparatus includes a developer; a heater below the developer; and a case for covering the heater. The apparatus further includes a first air duct of which an end in a first direction side communicates with the outside and which is formed at an inner side of the case, an end of the case in a second direction side opposite to the first direction side being blocked by a blocking plate; a duct arranged between the developer and the case, a second air duct of which an end on the first direction side communicates with the outside and contacting the case and which is formed at an inner side of the duct; a fan, arranged on the second direction side of both the first and second air ducts, configured to blow out air in the first direction side; a cover; and a guide.

20 Claims, 5 Drawing Sheets

IMAGE FORMING APPARATUS

FIELD

Embodiments described herein relate generally to an image forming apparatus.

BACKGROUND

An image forming apparatus is used to form an image on a sheet. The image forming apparatus may include a developing device and a heating element, such as a power supply unit. There is a possibility that a toner stored in the developing device bonds together to become a lump of toner due to a thermal effect of a heating element on the developing device. Accordingly, an image forming apparatus is required to be capable of suppressing the thermal effect of the heating element on the developing device.

DETAILED DESCRIPTION

In accordance with at least one embodiment, an image forming apparatus comprises a developing device; a heating element arranged below the developing device; a case configured to cover the heating element, a first air duct of which an end in a first direction side communicates with the outside being formed at an inner side of the case, and an end of the case in a second direction side opposite to the first direction being blocked by a blocking plate; a duct arranged between the developing device and the case, a second air duct of which an end on the first direction side communicates with the outside and contacting the case being formed at an inner side of the duct; a fan, arranged on the second direction side of both the first air duct and the second air duct, configured to blow out air in the first direction; a cover member configured to cover the second direction side of the first air duct, the second air duct and the fan; and a guide section configured to guide the air blown out of the fan to the first air duct.

Hereinafter, an image forming apparatus according to an embodiment are described with reference to the accompanying drawings.

In the present application, an X direction, a Y direction, and a Z direction are defined as follows. The X direction is a left and right direction of the image processing apparatus, and is a direction in which a first air duct and a second air duct described below extend. A +X direction (second direction) is a right direction towards the image processing apparatus (with respect to a paper surface of FIG. 1). A −X direction (first direction) is a left direction towards the image processing apparatus. The Y direction is a front and rear direction of the image processing apparatus. The widths of both the first air duct and the second air duct described below are measured in the Y direction. A +Y direction is a back direction of the image processing apparatus (the back side of the paper surface of FIG. 1). The Z direction is a vertical direction, and a +Z direction is the upper direction.

Figure 1:
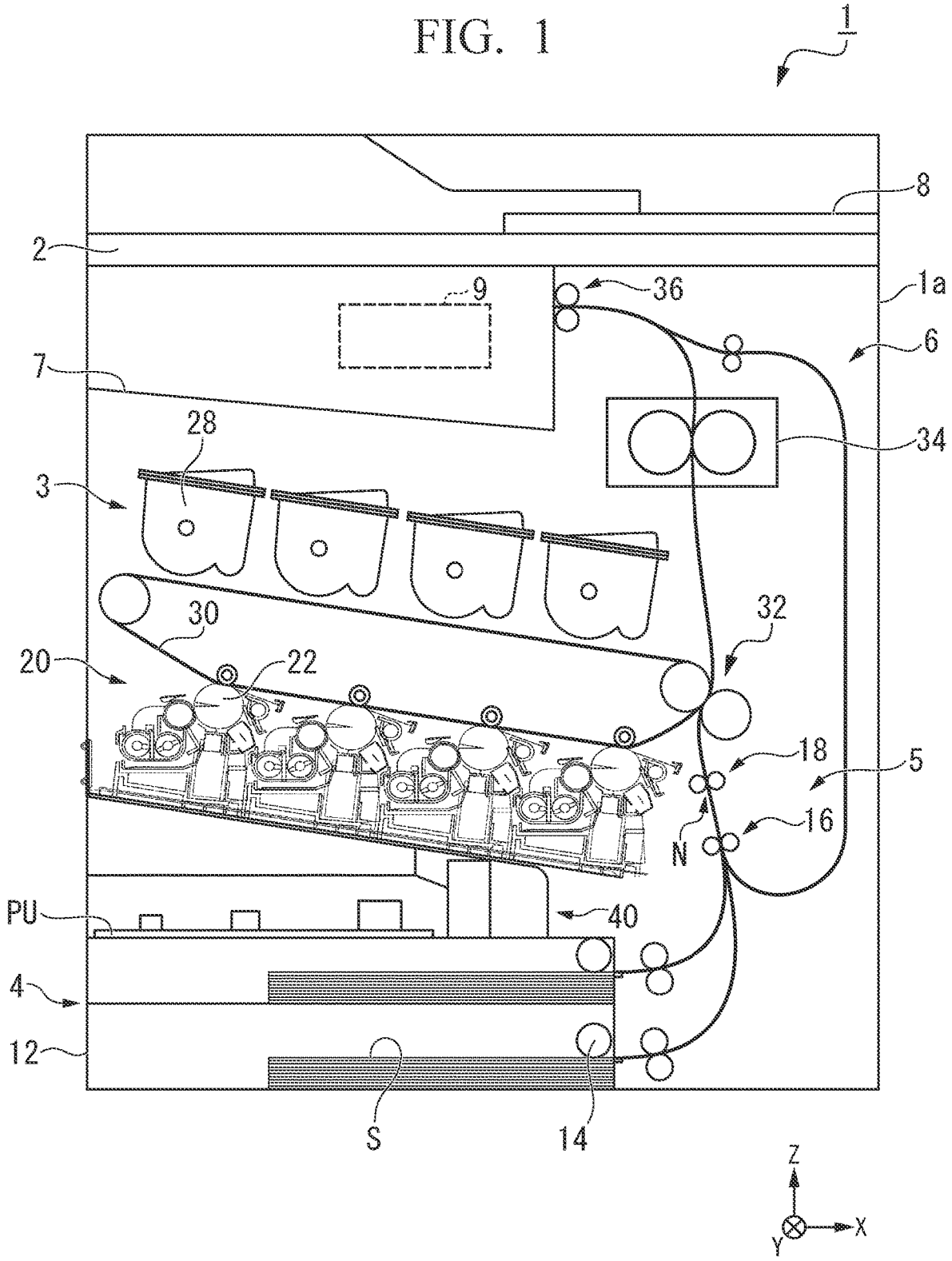
FIG. 1 is a diagram illustrating a schematic configuration of an image processing apparatus according to an embodiment.

FIG. 1 is a diagram illustrating a schematic configuration of an image processing apparatus of the embodiment. The image forming apparatus performs a processing for forming an image on a sheet. An image forming apparatus 1 includes a housing 1*a*, a scanner section (a scanner) 2, an image forming unit (an image former) 3, a sheet feed section (a sheet feeder) 4, a conveyance section (a conveyor) 5, a reversing unit (a reverser or re-router) 6, a sheet discharge tray 7, a control panel 8, a control section (a controller) 9, and a power supply unit (a power supply) PU.

The housing 1*a* forms an external shape of the image forming apparatus 1. The housing 1*a* accommodates components of the image forming apparatus 1 therein.

The scanner section 2 reads image information of an object to be copied as intensity of light in order to generate an image signal. The scanner section 2 outputs the generated image signal to the image forming unit 3.

The image forming unit 3 forms an output image (hereinafter referred to as a toner image) with a developer containing a toner and the like based on an image signal received from the scanner section 2 or an image signal received from an external device. The image forming unit 3 transfers the toner image onto a surface of a sheet S. The image forming unit 3 fixes the toner image to the sheet S. In other words, the image forming unit 3 performs an image forming processing on the sheet. A configuration of the image forming unit 3 is described below.

The sheet feed section 4 feeds sheets S one by one to the conveyance section 5 in accordance with a timing at which the image forming unit 3 forms a toner image. The sheet feed section 4 includes a cassette 12 and a pickup roller 14. The cassette 12 accommodates sheets S of a predetermined size and type. The pickup roller 14 picks up the sheets S one by one from the cassette 12. The pickup roller 14 feeds the sheet S picked up to the conveyance section 5.

The conveyance section 5 conveys the sheet S fed from the sheet feed section 4 to the image forming unit 3. The conveyance section 5 includes a conveyance roller 16 and a registration roller 18. The conveyance roller 16 conveys the sheet S fed from the pickup roller 14 to the registration roller 18. The conveyance roller 16 enables a tip of the sheet S in a conveyance direction against a nip N of the registration roller 18. The registration roller 18 aligns the tip position of the sheet S in the conveyance direction by bending the sheet S at the nip N. The registration roller 18 conveys the sheet S in accordance with a timing at which the image forming unit 3 transfers the toner image onto the sheet S.

A configuration of the image forming unit 3 is described below.

The image forming unit 3 includes a plurality of electrophotographic process units (hereinafter referred to as EPUs or electrophotographic processors) 20, a toner cartridge 28, an intermediate transfer belt 30, a transfer section (a transferor) 32, and a fixing device (a fixer) 34.

Figure 2:
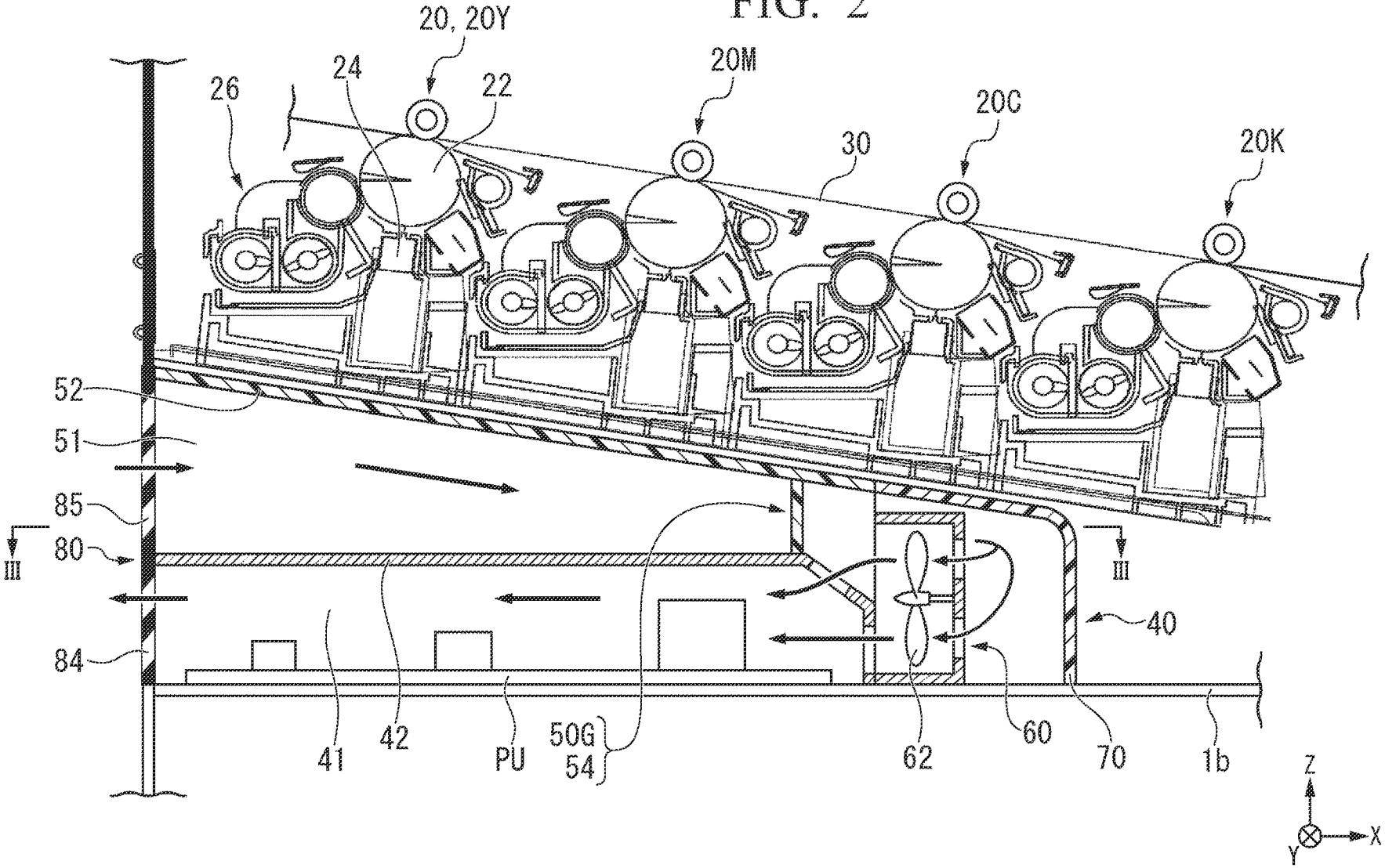
FIG. 2 is a front sectional view of a cooling unit.

FIG. 2 is a front sectional view of a cooling unit. The EPU 20 forms a toner image corresponding to an image signal from the scanner section 2 or the external device on a photoconductive drum 22. The plurality of EPUs 20Y, 20M, 20C, and 20K forms toner images with a yellow toner, a magenta toner, a cyan toner, and a black toner, respectively. The EPU 20 includes the photoconductive drum 22, an exposure device (exposer) 24 and a developing device (developer) 26. The photoconductive drum 22 includes a photoconductive layer of which a charge state changes due to exposure on an outer circumferential surface thereof. The exposure device 24 exposes the photoconductive drum 22 with light from a light emitting diode (LED) light source. The exposure device 24 forms an electrostatic latent image corresponding to an image signal on the photoconductive drum 22. The developing device 26 accommodates the developer containing the toner. The developing device 26 develops the electrostatic latent image on the photoconductive drum 22 with the toner to form a toner image on the photoconductive drum 22.

The image forming apparatus 1 is downsized in the X direction by reducing a distance in the X direction (a distance between the drums) between the photoconductive drums 22 of the adjacent EPUs 20. The adjacent EPUs 20 are arranged with positions thereof in the Z direction that are shifted from each other. The plurality of EPUs 20Y, 20M, 20C, and 20K is arranged in such a manner that the EPU 20 in the +X direction is positioned further towards a −Z direction. In this way, interference between the adjacent EPUs 20 is avoided, and the distance between the drums is reduced.

The toner cartridge 28 accommodates toner. As shown in FIG. 1, the toner cartridge 28 replenishes the toner to the developing device 26.

The intermediate transfer belt 30 is arranged across the plurality of EPUs 20Y, 20M, 20C, and 20K. The toner image on the photoconductive drum 22 is primarily transferred onto the intermediate transfer belt 30.

The transfer section 32 secondarily transfers the toner image primarily transferred onto the intermediate transfer belt 30 onto the surface of the sheet S.

The fixing device 34 applies heat and pressure to the sheet S to fix the toner image to the sheet S.

The reversing unit 6 reverses the sheet S to form an image on a back surface of the sheet S. The reversing unit 6 reverses the front and back surfaces of the sheet S discharged from the fixing device 34 through a switchback. The reversing unit 6 conveys the reversed sheet S towards the registration roller 18.

The sheet discharge tray 7 is used to place the sheet S discharged by a sheet discharge roller 36. The sheet discharge roller 36 discharges the sheet S on which an image is formed in the image forming unit 3 to the sheet discharge tray 7.

The control panel 8 is a part of an input section through which an operator inputs information for operating the image forming apparatus 1. The control panel 8 includes a touch panel and various hard keys.

The control section 9 controls each section of the image forming apparatus 1. The power supply unit PU transforms a commercial power supply voltage to supply it to the components of the image forming apparatus.

Generally, a laser unit that scans a laser beam to expose the photoconductive drum 22 is large. A laser unit may be arranged in the −Z direction side of the plurality of EPUs 20Y, 20M, 20C, and 20K shown in FIG. 2. On the other hand, the exposure device 24 of the embodiment exposes the photoconductive drum 22 with light from the LED light source, as described above. The exposure device 24 is downsized and arranged in the EPU 20, so as to be smaller than the laser unit. Therefore, a large space is available on the −Z direction side of the plurality of EPUs 20Y, 20M, 20C, and 20K. The power supply unit PU is arranged in the space on the −Z direction side of the plurality of EPUs 20Y, 20M, 20C, and 20K. In this way, the image forming apparatus 1 is downsized in the Y direction as compared to the case in which the power supply unit PU is arranged on the +Y direction side of the plurality of EPUs 20Y, 20M, 20C, and 20K.

The power supply unit PU is a heating element (a heater). The developing device 26 is arranged on the +Z direction side of the power supply unit PU. If the temperature of the developing device 26 rises due to the thermal effect of the power supply unit PU, there is a possibility that the toner accommodated in the developing device bonds together to become a lump of toner. If the lump of toner is clogged in the developing device 26, a development failure occurs in the toner image on the photoconductive drum 22. In this way, an image defect such as a white streak or a white spot occurs in the image formed on the sheet S. If the image forming apparatus 1 is intermittently operated to suppress the temperature rise of the developing device 26, the productivity of the image forming apparatus 1 is reduced.

In order to suppress the thermal effect of the power supply unit PU on the developing device 26, the image forming apparatus 1 includes a cooling unit (cooler) 40 for the power supply unit PU.

The cooling unit 40 is described below.

Figure 3:
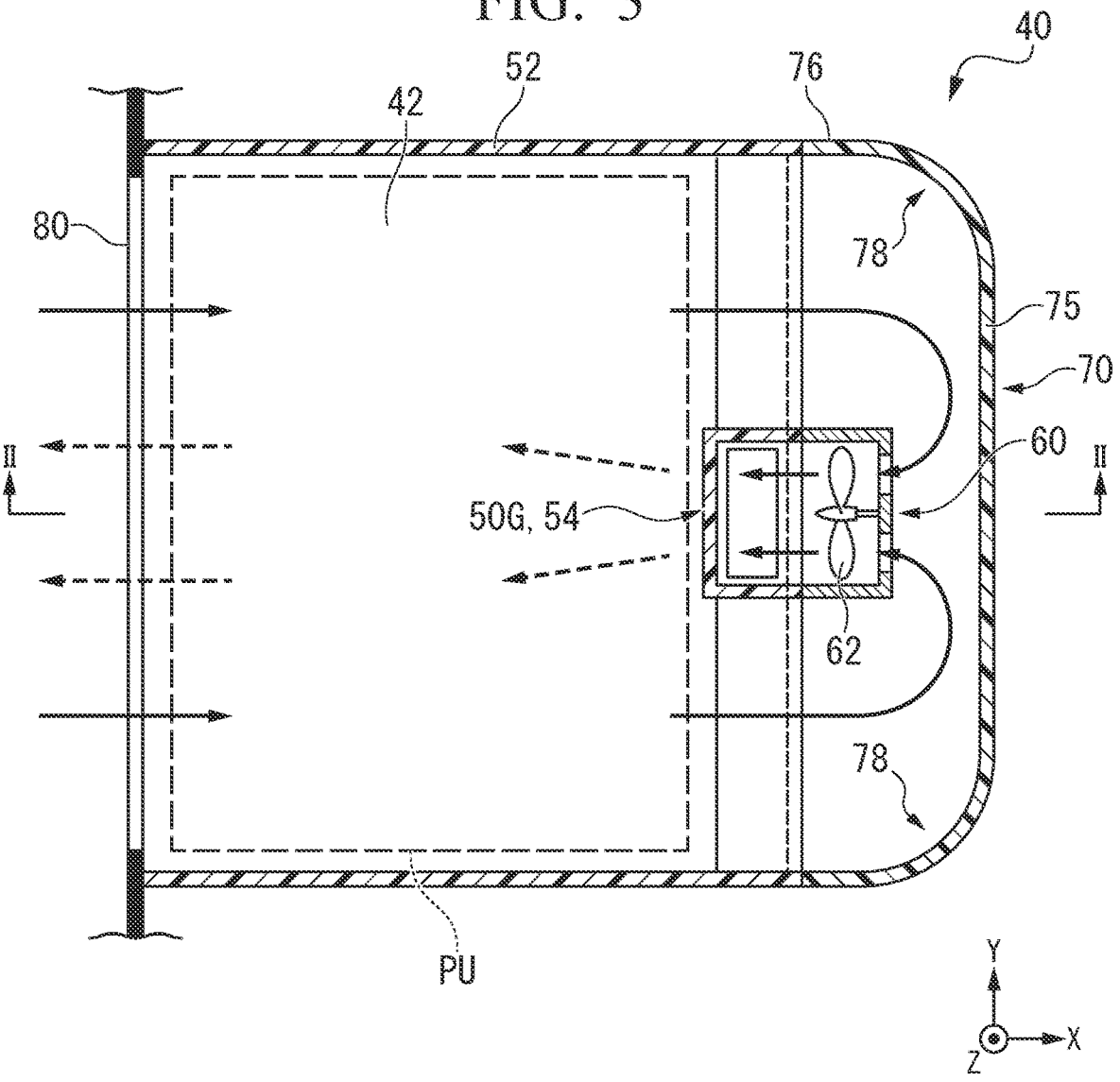
FIG. 3 is a plan sectional view of the cooling unit.

FIG. 2 is a front sectional view of the cooling unit, and is a cross-sectional view taken along a line II-II of FIG. 3. FIG. 3 is a plan sectional view of the cooling unit, and is a cross-sectional view taken along a line of FIG. 2. As shown in FIG. 2, the cooling unit 40 is arranged on the +Z direction side of a frame 1*b* of the image forming apparatus 1 together with the power supply unit PU. The cooling unit 40 includes a case 42, a duct 52, a fan unit (fan) 60, a cover member (second cover) 70, and a shielding portion (shield) 54.

The case 42 is made of a metal material or the like. The case 42 covers the +Z direction side, the +Y direction side, and a −Y direction side of the power supply unit PU while extending in the X direction. In the case 42, a first air duct 41 is formed. An end on the −X direction side of the case 42 closely contacts an exterior cover (first cover) 80 of the image forming apparatus 1. An opening 84 is formed in the exterior cover 80. The end on the −X direction side of the first air duct 41 communicates with the outside of the image forming apparatus 1 through the opening 84.

Figure 4:
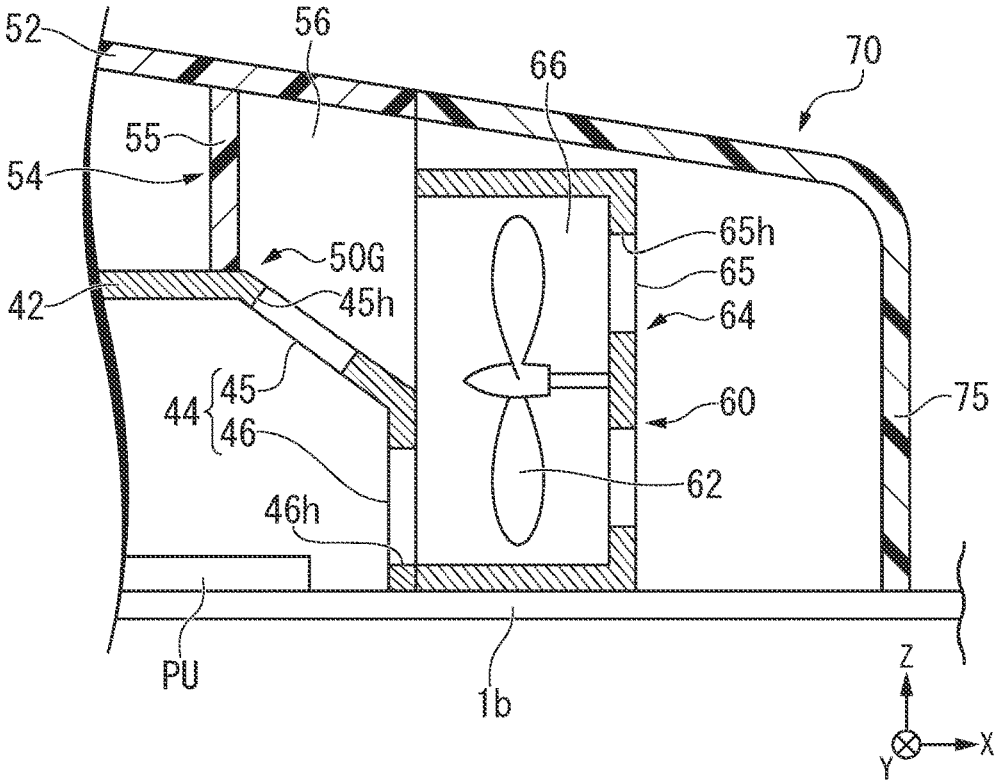
FIG. 4 is an enlarged view of the vicinity of a fan in FIG. 2.
Figure 5:
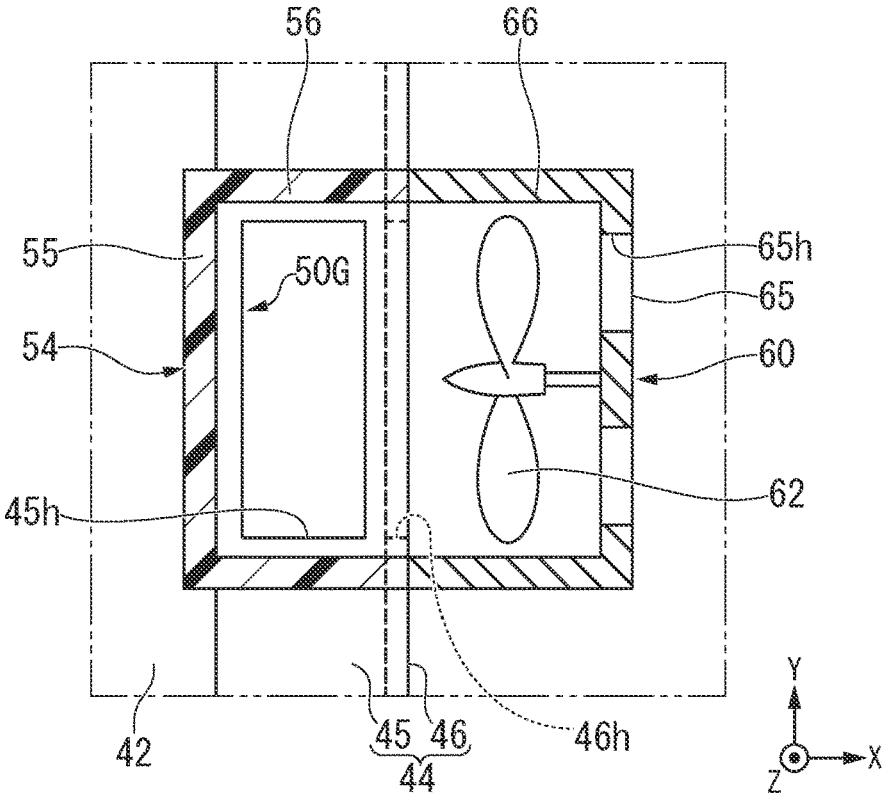
FIG. 5 is an enlarged view of the vicinity of a fan in FIG. 3.

FIG. 4 is an enlarged view of the vicinity of the fan in FIG. 2. FIG. 5 is an enlarged view of the vicinity of the fan in FIG. 3. As shown in FIG. 4, an end on the +X direction side of the case 42 (i.e., the first air duct 41) is blocked by a blocking plate 44. The blocking plate 44 is integrally formed with the case 42. The blocking plate 44 includes an inclined plate 45 arranged on the +Z direction side and a vertical plate 46 arranged on the −Z direction side. The inclined plate 45 is further inclined in the −Z direction towards the +X direction. The vertical plate 46 is parallel to a YZ plane.

The duct 52 is made of a resin material or the like. As shown in FIG. 2, the duct 52 is arranged between the developing device 26 and the case 42. A second air duct 51 is formed at the inner side of the duct 52. The duct 52 covers the +Z direction side, the +Y direction side and the −Y direction side of the second air duct 51 while extending in the X direction. As described above, the plurality of EPUs 20Y, 20M, 20C, and 20K is arranged in such a manner that the EPU in the +X direction is positioned further towards the −Z direction. A height in the Z direction of the duct 52 (i.e. the second air duct 51) becomes lower towards the +X direction. The −Z direction side of the second air duct 51 is covered by the case 42. Specifically, the second air duct 51 contacts the case 42. A length of the duct 52 in the X direction is equal to that of the case 42 in the X direction. An end on the −X direction side of the duct 52 closely contacts the exterior cover 80. An opening 85 is formed in the exterior cover 80. The end on the −X direction side of the second air duct 51 communicates with the outside of the image forming apparatus 1 through the opening 85. As shown in FIG. 3, an end on the +X direction side of the duct 52 (i.e., the second air duct 51) is open except for the shielding portion 54 described below.

The fan unit 60 is arranged on the +X direction side of the first air duct 41 and the second air duct 51, as shown in FIG. 2. As shown in FIG. 3, the fan unit 60 is arranged at the center of the cooling unit 40 in the Y direction. As shown in FIG. 4, the fan unit 60 includes a fan 62 and a fan case 64. The fan 62 is rotated by a motor (not shown). The fan case 64 is fixed to the frame 1*b*. As shown in FIG. 5, the fan case 64 includes a back plate 65 and a side plate 66. The back plate 65 is arranged on the +X direction side of the fan 62 to support the fan 62. The back plate 65 includes an air suction hole 65*h*. The side plate 66 is arranged on the +Y direction side and the −Y direction side of the fan 62. The side plate 66 closely contacts the surface of the vertical plate 46 on the +X direction side of the blocking plate 44. The fan case 64 is open on the −X direction side of the fan 62. The fan 62 rotates to suck the air from the +X direction side through the air suction hole 65*h* and to blow out the air in the −X direction.

The cover member 70 is made of a resin material or the like. As shown in FIG. 2, the cover member 70 covers the +X direction side of the first air duct 41 (case 42), the second air duct 51 and the fan unit 60. An end on the −X direction side of the cover member 70 closely contacts the ends on the +X direction side of the case 42 and the duct 52. The outer shape of the end on the −X direction side of the cover member 70 is the same as those of the ends on the +X direction side of the case 42 and the duct 52. As shown in FIG. 3, the cover member 70 includes a back plate 75, a side plate 76 and a curved plate 78. The back plate 75 is arranged away from the fan unit 60 in the +X direction. The side plate 76 is arranged away from the fan unit 60 in the +Y direction and the −Y direction. The curved plate 78 is arranged at a corner between the back plate 75 and the side plate 76. The curved plate 78 smoothly connects the back plate 75 with the side plate 76.

The shielding portion 54 is made of a resin material or the like. As shown in FIG. 2, the shielding portion 54 is integrally formed with the duct 52, and extends from the duct 52 in the −Z direction. The shielding portion 54 is arranged between the fan unit 60 and the second air duct 51 to cover the −X direction side of the fan unit 60. As shown in FIG. 5, the shielding portion 54 includes a main plate 55 and a side plate 56. The main plate 55 is parallel to the YZ plane. The main plate 55 is arranged away from the fan unit 60 in the −X direction. The main plate 55 is arranged at an end on the −X direction side of the blocking plate 44. The side plates 56 extend in the +X direction from both ends in the Y direction side of the main plate 55. The side plate 56 of the shielding portion 54 closely contacts the side plate 66 of the fan unit 60, such that at least part of the side plate 56 is flush with the side plate 66. As shown in FIG. 4, an end on the −Z direction side of the side plate 56 closely contacts the surface on the +Z direction side of the inclined plate 45.

As shown in FIG. 4, the blocking plate 44 includes a first ventilating hole 45*h* formed in the inclined plate 45 and a second ventilating hole 46*h* formed in the vertical plate 46.

As shown in FIG. 5, the first ventilating hole 45*h* opens to the inside of the shielding portion 54. The first ventilating hole 45*h* and the second ventilating hole 46*h* are formed in a portion of the blocking plate 44 facing the fan 62. The shielding portion 54, the first ventilating hole 45*h*, and the second ventilating hole 46*h* function as a guide section (a guide) 50G for guiding the air blown out of the fan to the first air duct 41.

An operation of the cooling unit 40 is described below.

As shown in FIG. 2, if the fan 62 rotates, the air flows from the opening 85 of the exterior cover 80 to the second air duct 51. The air circulates in the second air duct 51 in the +X direction. The air contacts the surface on the +Z direction side of the case 42 in the process of circulating in the second air duct 51. In this way, the case 42 is cooled. As shown in FIG. 3, the air flows out of the second air duct 51 through both sides in the Y direction of the shielding portion 54. The air flows into the cover member 70 through both sides in the Y direction of the fan unit 60. The air changes in a circulating direction thereof along the curved plate 78. The air flows in the Y direction along the back plate 75 and gathers in an area on the +X direction side of the fan unit 60.

As shown in FIG. 2, the fan 62 sucks the air from the +X direction side and blows out the air in the −X direction. The upper half of the air blown out of the fan 62 is received by the shielding portion 54. As shown in FIG. 4, the inclined plate 45 of the blocking plate 44 is arranged on the −Z direction side of the shielding portion 54. The inclined plate 45 is provided with the first ventilating hole 45*h* opening to the inner side of the shielding portion 54. The air received by the shielding portion 54 flows into the first air duct 41 through the first ventilating hole 45*h*. The lower half of the air blown out of the fan 62 flows into the first air duct 41 through the second ventilating hole 46*h*.

As shown in FIG. 2, the air circulates in the first air duct 41 in the −X direction, which is reverse to the second air duct 51. The air cools the power supply unit PU in the process of circulating in the first air duct 41. The air flows out of the opening 84 of the exterior cover 80 to the outside.

As described in detail above, the image forming apparatus 1 of the embodiment includes the developing device 26, the power supply unit PU, the case 42, the duct 52, the fan 62, the cover member 70 and the guide section 50G. The power supply unit PU is arranged below the developing device 26. The case 42 covers the power supply unit PU. The first air duct 41 is formed at the inner side of the case 42. The end on the −X direction side of the first air duct 41 communicates with the outside. The end on the +X direction side of the case 42 is blocked by the blocking plate 44. The duct 52 is arranged between the developing device 26 and the case 42. The second air duct 51 is formed at the inner side of the duct 52. The second air duct 51 contacts the case 42. The end on the −X direction side of the second air duct 51 communicates with the outside. The fan 62 is arranged on the +X direction side of the first air duct 41 and the second air duct 51. The fan 62 blows out the air in the −X direction. The cover member 70 covers the +X direction side of the first air duct 41, the second air duct 51, and the fan 62. The guide section 50G guides the air blown out of the fan 62 to the first air duct 41.

The second air duct 51 is formed between the case 42 covering the power supply unit PU and the developing device 26. Since the air flowing from the outside circulates in the second air duct 51, a low temperature air layer is formed in the second air duct 51.

The air layer can suppress the thermal effect of the power supply unit PU on the developing device 26. Since the temperature rise of the developing device 26 is minimized, the intermittent operation of the image forming apparatus 1 is minimized. Therefore, the decrease in productivity of the image forming apparatus 1 is minimized.

The fan 62 is arranged on the +X direction side of the first air duct 41 and the second air duct 51. A large fan 62 corresponding to the height of the first air duct 41 and the second air duct 51 can be employed. The fan 62 blows out the air in the −X direction towards the power supply unit PU to be cooled. In this way, the power supply unit PU can be cooled efficiently.

The guide section 50G includes the shielding portion 54 and the first ventilating hole 45*h*. The shielding portion 54 is arranged between the fan 62 and the second air duct 51 to cover the −X direction side of the fan 62. The first ventilating hole 45*h* is formed in the blocking plate 44 and opens to the inner side of the shielding portion 54.

The air blown out of the fan 62 is received by the shielding portion 54 arranged on the −X direction side of the fan 62. The air received by the shielding portion 54 flows into the first air duct 41 through the first ventilating hole 45*h* opening to the inside the shielding portion 54. Thus, the guide section 50G guides (i.e., directs) the air blown out of the fan 62 to the first air duct 41.

The blocking plate 44 includes the inclined plate 45 inclined downward towards the +X direction. The first ventilating hole 45*h* is formed in the inclined plate 45.

The shielding portion 54 includes the main plate 55 and the side plate 56. The main plate 55 is arranged at the end in the −X direction side of the inclined plate 45. The side plates 56 extend in the +X direction from both ends of the main plate 55 in the Y direction.

The side plate 56 prevents the air received by the main plate 55 from escaping in the Y direction. The main plate 55 is arranged at the end on the −X direction side of the inclined plate 45, and the first ventilating hole 45*h* is formed in the inclined plate 45. In this way, the air received by the main plate 55 efficiently flows into the first ventilating hole 45*h*.

The cover member 70 includes the back plate 75, the side plate 76 and the curved plate 78. The back plate 75 is arranged away from the fan 62 in the +X direction. The side plate 76 is arranged away from the fan 62 in the Y direction. The curved plate 78 connects the back plate 75 with the side plate 76.

A circulating direction of the air flowing out of the second air duct 51 is changed from the +X direction to the Y direction at the cover member 70. The air circulates along the curved plate 78, and in this way, the decrease in the air speed due to the change in the circulating direction is minimized.

The first air duct 41 and the second air duct 51 are formed below a plurality of developing devices 26.

In this way, the thermal effect of the power supply unit PU on the plurality of the developing devices 26 is minimized.

The height in the vertical direction of the second air duct 51 becomes lower towards the +X direction.

The second air duct 51 communicates with the outside at the end on the −X direction side thereof. Since the height on the −X direction side of the second air duct 51 is high, the air tends to flow into the second air duct 51.

The first air duct 41 and the second air duct 51 communicate with the outside through the openings 84 and 85 formed in the exterior cover 80.

Both the opening 84 of the first air duct 41 and the opening 85 of the second air duct 51 are formed in the same exterior cover 80. Therefore, a manufacturing cost of the openings 84 and 85 is suppressed.

As shown in FIG. 3, the fan 62 of the embodiment is arranged at the center in the Y direction of the cooling unit 40. Alternatively, the fan 62 may be arranged at a position other than the center in the Y direction of the cooling unit 40.

Figure 6:
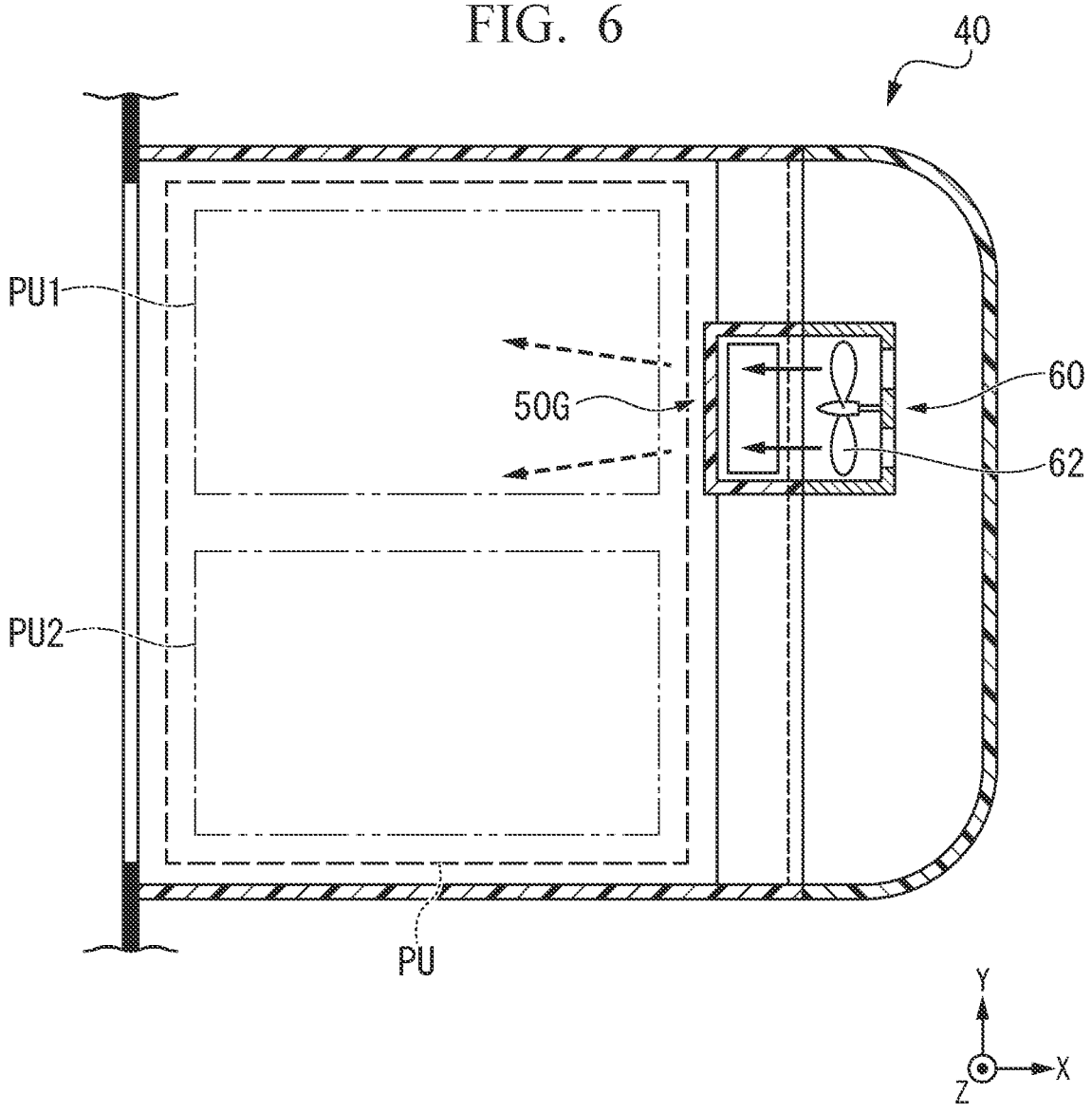
FIG. 6 is a plan sectional view of the cooling unit according to a modification of the embodiment.

FIG. 6 is a plan sectional view of a cooling unit according to a modification of the embodiment. FIG. 6 is a cross-sectional view of a portion along the line of FIG. 2.

As described above, the power supply unit PU transforms the commercial power supply voltage to supply it to the components of the image forming apparatus 1. Therefore, the power supply unit PU includes a primary side circuit PU1 and a secondary side circuit PU2. The primary side circuit PU1 is connected to a commercial power supply. The secondary side circuit PU2 is connected to the components of the image forming apparatus 1 and not to the commercial power supply. A heat generation amount of the primary side circuit PU1 is larger than that of the secondary side circuit PU2. Therefore, the fan 62 is arranged closer to the primary side circuit PU1 with respect to the center of the cooling unit 40 in the Y direction. In this way, the primary side circuit PU1 of which the heat generation amount is large is efficiently cooled.

The cooling unit 40 of the embodiment described above includes one fan 62 and the guide section 50G. Alternatively, the cooling unit 40 may have a plurality of fans 62 and guide sections 50G.

In the embodiment described above, the duct 52 and the cover member 70 are separately formed. Alternatively, the duct 52 and the cover member 70 may be integrally formed.

The shielding portion 54 of the embodiment described above is integrally formed with the duct 52. Alternatively, the shielding portion 54 may be integrally formed with the cover member 70. The shielding portion 54 may be formed separately from the duct 52 and the cover member 70.

According to at least one embodiment described above, the second air duct 51 is provided between the case 42 covering the power supply unit PU and the developing device 26. In this way, the thermal effect of the power supply unit PU on the developing device 26 can be minimized.

While certain embodiments have been described these embodiments have been presented by way of example only, and are not intended to limit the scope of the present disclosure. Indeed, the novel embodiments described herein may be embodied in a variety of other forms: furthermore various omissions, substitutions and changes in the form of the embodiments described herein may be made without departing from the spirit of the present disclosure. The accompanying claims and there equivalents are intended to cover such forms or modifications as would fall within the scope and spirit of the present disclosure.

What is claimed is:

1. An image forming apparatus comprising:

a first cover comprising a first opening and a second opening configured to facilitate passage of air through the image forming apparatus;

a developer;

a heater arranged below the developer;

a case configured to cover the heater and having a first end proximate the first opening and a second end opposite the first end, the case comprising:

a first air duct configured to facilitate passage of air through the first end and the first opening; and a blocking plate configured to at least partially block passage of air through the second end;

a second air duct arranged between the developer and the case, which is in contact with the case and configured to facilitate passage of air through the second opening;

a fan located proximate the second end and configured to propel air towards the first end;

a second cover configured to cover a portion of the first air duct, a portion of the second air duct, and the fan; and a guide configured to direct air propelled by the fan to the first air duct.

2. The image forming apparatus of claim 1, wherein:

the guide comprises a shielding portion arranged between the fan and the second air duct, the shielding portion covering a portion of the fan proximate the second end; and the blocking plate comprises a first ventilating hole proximate the shielding portion.

3. The image forming apparatus of claim 2, wherein:

the blocking plate comprises an inclined plate that is inclined downward towards the first air duct; and the first ventilating hole is formed in the inclined plate.

4. The image forming apparatus of claim 3, wherein the shielding portion comprises:

a main plate coupled to the inclined plate;

a first side plate coupled to the main plate and extending towards the fan; and a second side plate coupled to the main plate opposite the first side plate and extending towards the fan.

5. The image forming apparatus of claim 1, wherein the second cover comprises:

a side plate extending along the case towards the first cover;

a curved plate coupled to the side plate; and a back plate coupled to the side plate and extending along the fan.

6. The image forming apparatus of claim 1, wherein the heater comprises a power supply.

7. The image forming apparatus of claim 6, wherein:

the power supply comprises a primary side circuit and a secondary side circuit;

the image forming apparatus is defined by a first direction between the first end and the second end and a width direction that is orthogonal to the first direction; and a center of the fan is arranged closer to the primary side circuit than to the secondary side circuit in the width direction.

8. The image forming apparatus of claim 1, wherein the first air duct and the second air duct are arranged below a plurality of developers.

9. The image forming apparatus of claim 1, wherein:

the image forming apparatus is defined by a first direction between the first end and the second end and a vertical direction that is orthogonal to the first direction; and the second air duct is defined by a height measured along the vertical direction; and the height decreases along the first direction from the first end to the second end.

10. An image forming apparatus comprising:

a first cover comprising a first opening and a second opening configured to facilitate passage of air through the image forming apparatus;

a case covered by the first cover, the case having a first end in contact with the first cover proximate the first opening and a second end opposite the first end, the case comprising a first air duct in contact with the first end and configured to facilitate passage of air to the first opening;

a second air duct positioned within the first cover and external to the case, the second air duct configured to facilitate passage of air from the second opening towards the second end;

at least one developer that is external to the second air duct and the case, and at least partially separated from the case by the second air duct; and a power supply located within the case and separated from the at least one developer by the case and the second air duct.

11. The image forming apparatus of claim 10, further comprising a fan positioned within the first cover and external to the case, the fan located proximate the second end and configured to propel air into the case towards the first end and across the power supply.

12. The image forming apparatus of claim 11, wherein:

the power supply comprises a primary side circuit and a secondary side circuit;

the primary side circuit is larger than the secondary side circuit;

the primary side circuit is configured to be coupled to a commercial power supply;

the secondary side circuit is not configured to be coupled to a commercial power supply;

the image forming apparatus is defined by a first direction between the first end and the second end and a width direction that is orthogonal to the first direction; and a center of the fan is arranged closer to the primary side circuit than to the secondary side circuit in the width direction.

13. The image forming apparatus of claim 11, wherein the case comprises a blocking plate located at the second end, the blocking plate comprising an opening configured to facilitate passage of air from outside of the case into the case, the opening aligned with the fan.

14. The image forming apparatus of claim 13, further comprising a guide configured to guide air propelled by the fan to the first air duct, the guide comprising a shielding portion arranged between the fan and the second air duct, the shielding portion covering a portion of the fan proximate the second end.

15. The image forming apparatus of claim 14, wherein the blocking plate comprises a first ventilating hole proximate the shielding portion.

16. The image forming apparatus of claim 15, wherein:

the blocking plate further comprises an inclined plate that is inclined downward towards the first air duct; and the first ventilating hole is formed in the inclined plate.

17. The image forming apparatus of claim 16, wherein the shielding portion comprises:

a main plate coupled to the inclined plate;

a first side plate coupled to the main plate and extending towards the fan; and a second side plate coupled to the main plate opposite the first side plate and extending towards the fan.

18. An image forming apparatus comprising:

a first cover comprising a first opening and a second opening configured to facilitate passage of air through the image forming apparatus;

a case positioned within the first cover, the case having a first end in contact with the first cover proximate the first opening and a second end opposite the first end, the case comprising:

a first air duct in contact with the first end and configured to facilitate passage of air to the first opening; and a second air duct positioned within the first cover and external to the case, the second air duct configured to facilitate passage of air from the second opening towards the second end;

a developer that is external to the second air duct and the case, and at least partially separated from the case by the second air duct; and a fan positioned within the first cover and external to the case, the fan located proximate the second end and configured to propel air into the case towards the first end.

19. The image forming apparatus of claim 18, wherein the case comprises a blocking plate located at the second end, the blocking plate comprising an opening configured to facilitate passage of air from outside of the case into the case, the opening aligned with the fan.

20. The image forming apparatus of claim 19, further comprising a guide configured to guide air propelled by the fan to the first air duct, the guide comprising a shielding portion arranged between the fan and the second air duct, the shielding portion covering a portion of the fan proximate the second end;

wherein the blocking plate comprises a first ventilating hole proximate the shielding portion;

wherein the blocking plate further comprises an inclined plate that is inclined downward towards the first air duct;

wherein the first ventilating hole is formed in the inclined plate; and wherein the shielding portion comprises:

a main plate coupled to the inclined plate;

a first side plate coupled to the main plate and extending towards the fan; and a second side plate coupled to the main plate opposite the first side plate and extending towards the fan.

* * * * *